United States Patent [19]

Fernbaugh et al.

[11] Patent Number: 5,058,841

[45] Date of Patent: Oct. 22, 1991

[54] SADDLE SUPPORT

[76] Inventors: James B. Fernbaugh; Bonnie J. Fernbaugh, both of 7992 Soquel Dr., Aptos, Calif. 95003

[21] Appl. No.: 448,279

[22] Filed: Dec. 11, 1989

[51] Int. Cl.[5] ..... A47G 29/00

[52] U.S. Cl. ..... 248/126; 248/151; 248/165

[58] Field of Search ..... 248/126, 309.1, 553, 248/176, 163.1, 165, 151; 211/87, 13; D30/143; 70/78–84

[56] References Cited

U.S. PATENT DOCUMENTS

| | | | |
|---|---|---|---|
| D. 173,717 | 12/1954 | Bull | D30/143 |
| D. 221,871 | 9/1971 | Pearce | D30/143 |
| D. 277,989 | 3/1985 | Wakat | D30/143 |
| 1,622,506 | 3/1927 | Graves | 248/151 |
| 1,955,147 | 4/1934 | Remington | 248/151 |
| 2,890,812 | 6/1959 | Vorwerk | 248/151 |
| 3,780,971 | 12/1973 | De Fillipps | 248/309.1 |
| 3,827,773 | 8/1974 | Aiello | 70/81 |

*Primary Examiner*—Allan D. Herrmann
*Assistant Examiner*—Andrea Pitts
*Attorney, Agent, or Firm*—John P. Halvonik

[57] ABSTRACT

A saddle stand for horse saddles that can be used in various ways, either set at rest against a wall or stood upright to hold a saddle. The saddle stand provides a convenient place to store valuables in its interior as well as a saddle holder that can be used in cramped areas where it takes up little space.

2 Claims, 2 Drawing Sheets

SADDLE SUPPORT

BACKGROUND OF THE INVENTION

1. Field of the Invention

The invention relates to a stand for a saddle that is used as a storage rest for a saddle when the saddle is not in use. The saddle stand supports the saddle off the ground so that it does not become stressed or cracked by resting directly on the ground or floor. The present invention has the added utility in that it can be used in an upright position or be hung against a wall. The latter mode is ideal when the saddle is to be stored in a cramped space, for instance inside a trailer on long drives. The interior of the stand provides a lockable space that can be used to store valuables.

2. Description of the Prior Art

The concept of using a saddle holder to support the saddle during storage is known and there are patents that teach this. None of the saddle holders in the prior art possess all of the advantages of the present invention in that the unit can be optionally wall mounted or upright mounted and contain an interior storage space for valuables, etc. The saddle holder of the present invention has advantages over the typical saddle holders in the prior art, among them:

a. Some saddle holders cannot be wall mounted. This is a disadvantage in as much as many times storage of saddles is in tight spaces. A unit that can be wall mounted takes up less space and is less likely to shift around when the storage vehicle is moving.

b. The interior storage space of the holder provides a handy resting place for valuables, medicine, etc. Oftentimes it would be convenient to be able to bring these along with the horse and rider when they leave the vehicle and go to the site of an equestrian event. As the saddle is brought out the medicine, etc. is inside the holder. This would save one the trouble of having to make an extra trip after the saddle is brought along. In addition, the saddle can be stood upright at the track or field. The saddle would be removed from the wall of the trailer and then stood up right at the track or wherever the event is held.

c. The use of the wall mounted support would be achieved at a minimum cost in terms of time and energy required to set it up. The only other item necessary to use the holder in the wall mounted mode would be an eyelet that can be installed into the wall of the horse trailer or any other wall that the holder is desired to be used on. While other installation methods are available, the preferred means is the one recited. This provides the most support for the saddle in that the hook can be double bolted onto the top of the tube and into one of the top ribs.

SUMMARY OF THE INVENTION

A saddle support that can be used in an upright or wall-supported mode. The main body of the holder is made of a tube of sheet material long enough to support a saddle. Hooks are mounted at the back of the tube so that the tube can be mounted on a wall through means of a hook and eyelet arrangement. Legs can be attached to the support tube when the holder is used in the upright position.

Among the objectives of the invention is to provide a saddle holder that can be used in both upright and against-the-wall positions.

Another objective is to provide a saddle support that can be used to hold cleaning supplies, saddle accessories, valuable items and veterinary supplies.

DESCRIPTION OF THE PREFERRED EMBODIMENT

Construction of the saddle support is as follows:

The main body of the device is an elliptical tube 1 of sheet material long enough to support a saddle. FIG. 1A shows the preferred shape. "As can be seen in FIG. 1, this shape is roughly elliptical with the width of the holder being longer than the height of the holder when viewed from the front of the tube." Similar shapes are also usable with the proviso that the shape of the holder should provide a resting surface for the saddle that nearly matches the shape and contours of the saddle itself. Shapes that are more contoured than that shown in FIG. 1A are also possible but this leads to an increased cost that may well be not worth it.

Figure 1B:
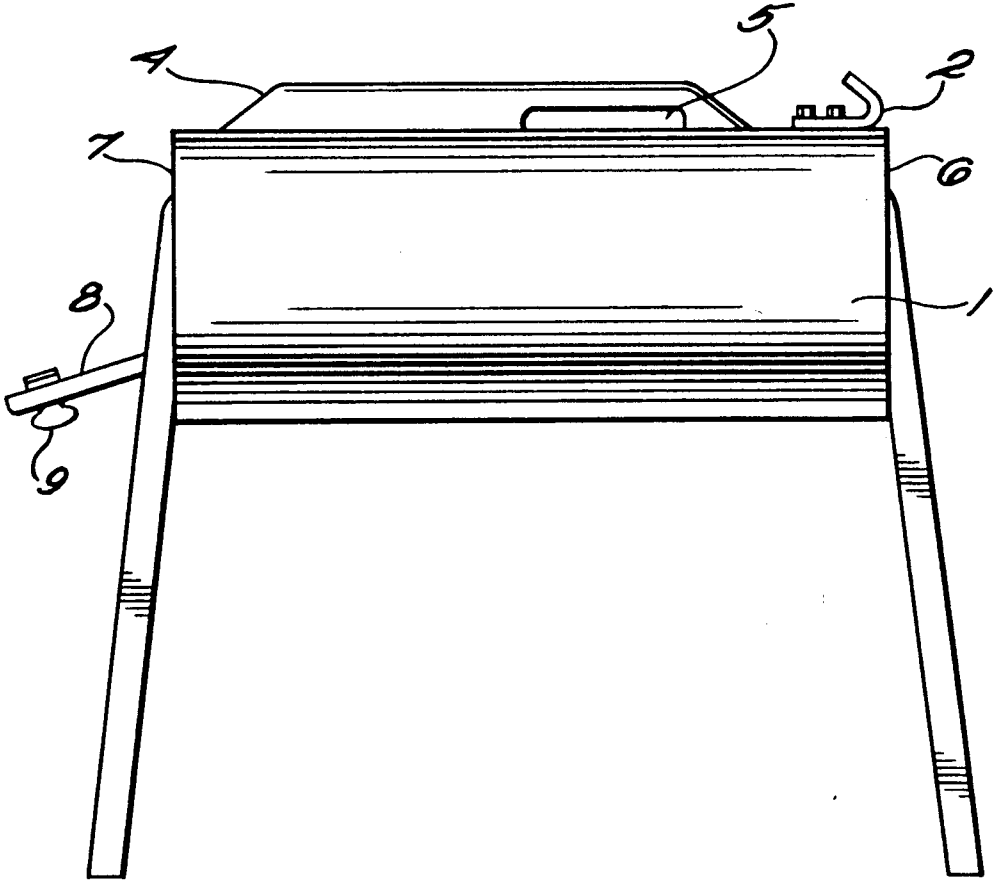
FIG. 1B shows a side view of the saddle holder in its preferred construction the wall-mounted mode resting against a wall.
Figure 1A:
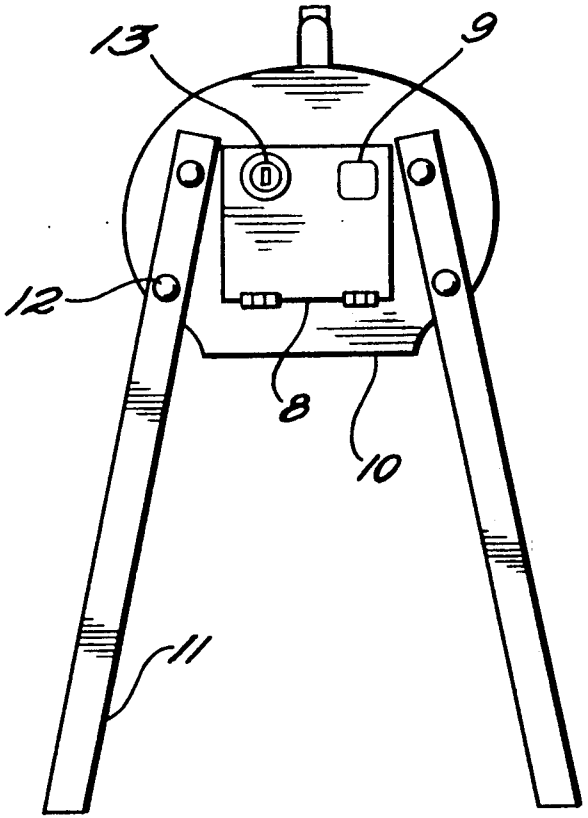
FIG. 1A shows a front view of the saddle holder in its preferred construction.
Figure 2:
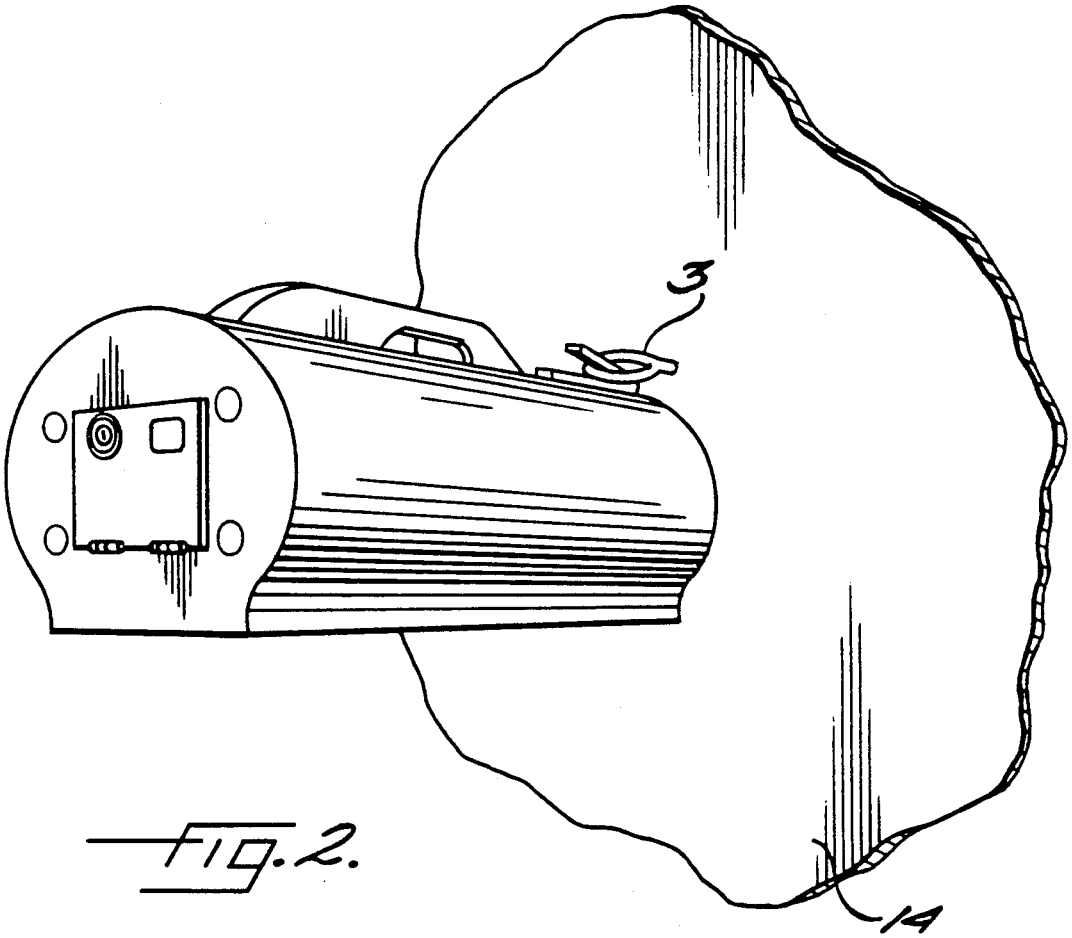

On the top and at the back of the tube 1 is mounted a hook 2 FIG. 1B. This hook provides the support means for the saddle when it is used in the wall supported position. In this mode, the hook is set on an eyelet 3 that is screwed into or otherwise hold against a wall or similar supporting structure as viewed in FIG. 2. Other attaching means are possible with the requirement that they provide a sturdy means of support for the weight and size of the saddle.

Along the top of the tube, front to back, is secured a spine 4 to discourage shifting of the saddle. "As can be seen in FIG. 1, the spine is simply a narrow, raised up portion that runs nearly the length of the tube." In this spine a cutout 5 has been provided as a handhold. See FIG. 1B. The front and back of the tube are sealed with end caps to strengthen the device and contain the space inside of the tube for storage. The back end cap 6 is plain. The front end cap 7 is fitted with a door 8 wherein a lock 13 is installed. A catch and knob 9 complete door installation.

The bottom 10 of the tube 1 is flat to improve the storage utility. Support ribs (not shown) extend from front to back inside the top of the tube 1 for added strength. The end caps 6 and 7 and legs 11 are also predrilled to accommodate carriage bolts 12 so that legs 11 can be attached to the support, it can then function in the upright mode. These bolts can be attached by any suitable means with threaded arrangements also possible, that shown in FIG. 2 with the predrilled holes in the end caps and legs is thought to be the preferred method in terms of simplicity of installation and cost to produce.

The tube 1 itself can be made of any material with polyvinyl chloride plastic being preferred based on its strength, ease of construction and the cost.

Instructions for usage:

a. Decide which method of storage is desired: wall or upright. Again, wall mounted is preferred in areas where there is a premium on space, such as in a trailer. The upright mode of support would obviously be used where there are no walls to support the eyelet, typically in a field or other outdoor environment.

b. Wall installation requires screwing an eyelet that would be provided with the support into a wall 14 or other structural support at a height suitable for storage and cleaning of the saddle. Orient the eyelet horizontally and deeply enough so the hook on the saddle support passes through the hole vertically from the bottom and the back end cap rests squarely against the wall.

c. Storage access is provided through a door in the front end cap. Valuables and other articles are placed here. The lock can be rotated into the locked or unlocked position as desired. A door catch is used to keep the door shut when the door is unlocked.

d. Floor installation requires installation of four legs. Two legs are mounted to the front end cap and two legs are mounted to the back end cap. Bolts are installed in predrilled holes in the legs and end caps to place the legs in the proper positions.

I claim:

1. A saddle holder for holding horse saddles for wall mounting and floor mounting comprising: a hollow support tube capable of supporting the weight of said saddle and capable of storing objects in the interior of said tube, said tube having a contoured shape, said shape being elliptical in nature with the width of said tube longer than the height of said tube so that said shape of said tube can conform to the shape of said saddle, spine means on the top surface of said tube and running about the length of said tube so that said saddle can be secured in place, hook located on the top surface of said tube an at one end of said tube, said hook capable of supporting said holder from a wall mounted eyelet, vertical support means attached to said tube and capable of being detached form said tube, wherein said saddle holder is made substantially of Polyvinyl choride.

2. A saddle holder for holding horse saddles for wall mounting and floor mounting comprising: a hollow support tube capable of supporting the weight of said saddle and capable of storing objects in the interior of said tube, said tube having a contoured shape, said shape being elliptical in nature with the width of said tube longer than the height of said tube so that said shape of said tube can conform to the shape of said saddle, spine means on the top surface of said tube and running about the length of said tube so that said saddle can be secured in place, hook located on the top surface of said tube and at one end of said tube, said hook capable of supporting said holder from a wall mounted eyelet, vertical support means attached to said tube and capable of being detached from said tube, wherein said spine means has an open interior portion so that said spine means can function as a handle for carrying said holder.

* * * * *